US007963722B2

(12) United States Patent
Kögler

(10) Patent No.: US 7,963,722 B2
(45) Date of Patent: Jun. 21, 2011

(54) METHOD FOR THE TRENCHLESS LAYING OF PIPES

(75) Inventor: Rüdiger Kögler, Nordgeorgsfehn (DE)

(73) Assignee: Meyer & John GmbH & Co KG, Hamburg (DE)

( * ) Notice: Subject to any disclaimer, the term of this patent is extended or adjusted under 35 U.S.C. 154(b) by 611 days.

(21) Appl. No.: 11/913,841

(22) PCT Filed: Aug. 31, 2005

(86) PCT No.: PCT/EP2005/009397
§ 371 (c)(1),
(2), (4) Date: May 28, 2008

(87) PCT Pub. No.: WO2006/119797
PCT Pub. Date: Nov. 16, 2006

(65) Prior Publication Data

US 2008/0247826 A1 Oct. 9, 2008

(30) Foreign Application Priority Data

May 7, 2005 (DE) ..... 10 2005 021 216

(51) Int. Cl.
*E21B 7/04* (2006.01)

(52) U.S. Cl. ..... 405/184; 175/61; 175/62

(58) Field of Classification Search ..... 405/184, 405/184.1; 175/53, 61, 62
See application file for complete search history.

(56) References Cited

U.S. PATENT DOCUMENTS 4,117,895 A * 10/1978 Ward et al. ..... 175/53
4,319,648 A * 3/1982 Cherrington ..... 175/53
4,542,796 A * 9/1985 Delbarre ..... 175/19
4,785,885 A * 11/1988 Cherrington et al. ..... 166/285
4,993,503 A * 2/1991 Fischer et al. ..... 175/62
5,205,671 A * 4/1993 Handford ..... 405/184.3
5,240,352 A * 8/1993 Ilomaki ..... 405/184
5,351,764 A * 10/1994 Cherrington ..... 175/53
5,375,945 A * 12/1994 Cherrington ..... 405/184
6,755,593 B2 * 6/2004 Wentworth et al. ..... 405/184.3
7,347,282 B2 * 3/2008 Betts et al. ..... 175/61
2005/0161261 A1 * 7/2005 Betts et al. ..... 175/61

FOREIGN PATENT DOCUMENTS

DE 10120186 C1 * 10/2002
EP 0291193 A1 11/1988
GB 2164718 A1 3/1986

OTHER PUBLICATIONS

Stein, D., Grabenloser Leitengsbau, "Trenchless Line Construction,"2003 Ernst & Sohn Verlag für Architektur und technische Wissenschaften GmbH & Co. KG, Berlin, ISBN 3-433-01778-6.

Tunnels & Tunnelling International, "Pipe jack comes to the rescue in Berlin," pp. 18-21 (Published Mar. 2005).

* cited by examiner

*Primary Examiner* — Tara Mayo-Pinnock
(74) *Attorney, Agent, or Firm* — Hovey Williams LLP

(57) ABSTRACT

In a method for the trenchless laying of pipes, a drilling operation (5) is firstly carried out by means of controlled heading from a starting point (1) to a finishing point (6). Then the drilling head (3) is disconnected from the heading pipes (4) and the heading pipe run is connected by means of a special connecting pipe to the product pipe run (9), which is prefabricated above ground at the finishing point (6). Subsequently, the heading pipes (4) are drawn back from the drill hole to the starting point (1), the product pipe run (9) simultaneously being drawn into the drill hole.

20 Claims, 7 Drawing Sheets

Figure 1A:
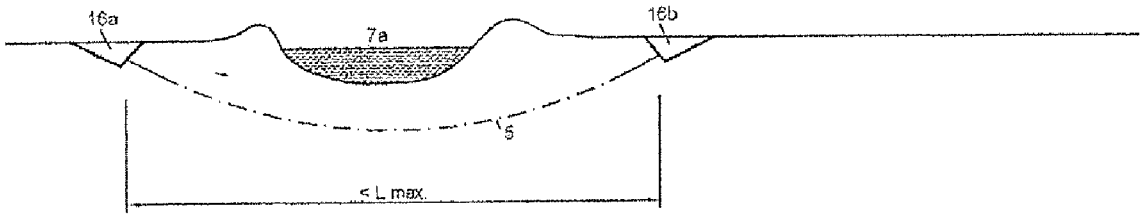
Figure 1B:
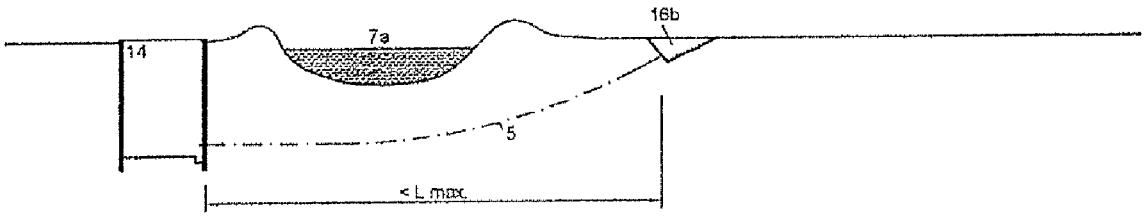
Figure 1C:
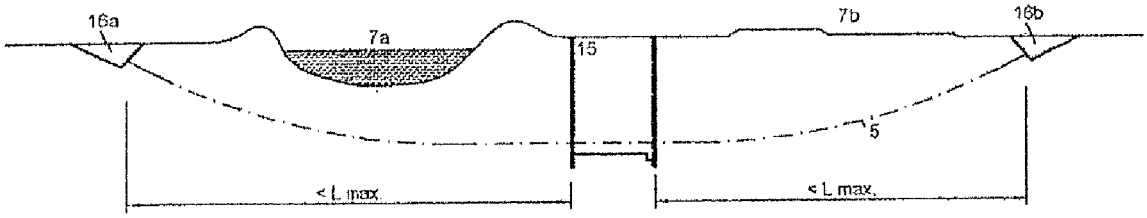
Figure 1D:
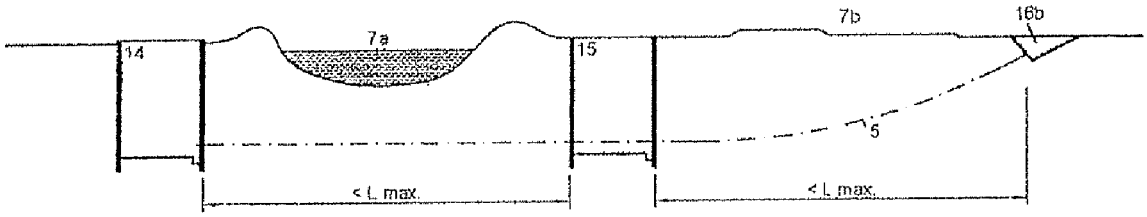

| | MT | HDD | NEW |
|---|---|---|---|
| Drill hole: | 1.850 mm (ID) | 1.500 mm (ID) | 1.200 mm (ID) |
| Protective pipe: | 1.800 mm (OD) | - | - |
| Product pipe: | 1.130 mm (OD) | 1.130 mm (OD) | 1.130 mm (OD) |
| Drill hole volume (per meter of drill hole): | 2,69 $m^3$ = 100 % | 1,77 $m^3$ = 66 % | 1,13 $m^3$ = 42 % |

METHOD FOR THE TRENCHLESS LAYING OF PIPES

CROSS REFERENCE TO RELATED APPLICATIONS

This is a National Phase Application pursuant to 35 USC §371 of International Application No. PCT/EP2005/009397, filed Aug. 31, 2005, claiming priority of German Application No. DE 10 2005 021 216.6, filed May 7, 2005, both of which are hereby incorporated by reference herein.

BACKGROUND

1. Field

The present invention relates to a method and devices that can be used therein for the trenchless laying of pipelines in the ground.

2. Discussion of Prior Art

In the past, numerous methods and devices have been developed for laying pipelines in the ground without using trenches in order to pass under sensitive areas on the surface of the land for which laying in an open pipe trench did not appear to be possible or advisable for technical, ecological, legal or economic reasons. This may be the case for example whenever heavy construction machinery cannot travel onto the surface in the laying area (for example moors, bodies of water) or where no authorization for construction work can be granted from an ecological viewpoint (for example in nature conservation areas) or where the use of conventional laying techniques would be too expensive (for example where laying depths are great and the level of the groundwater is high).

In the literature there are extensive works on the laying methods that have already been used and tried out (for example Stein, D., *Grabenloser Leitungsbau [trenchless line construction]*, 2003 *Ernst & Sohn Verlag für Architektur und technische Wissenschaften GmbH & Co. KG, Berlin, ISBN* 3-433-01778-6). These have found that it is best for the method to be divided up on the basis of controllability (controlled/uncontrolled methods), soil handling (soil displacement/soil removal), transport of spoil (mechanical, hydraulic) and the number of working steps (pilot drilling, expansion drilling, drawing-in or pushing-in operation). Further distinguishing features are, for example, the basic geometrical formation of the drilling axis (straight, curved) and the pipe materials to be laid by means of the respective methods (for example concrete, PE, cast iron, steel, etc.). Furthermore, the achievable drilling dimensions (length, diameter, volume) are already among the suitable criteria for assigning specific methods to the same or a different group of methods.

Special attention also has to be given to the suitability of the methods for specific types of soil (grain size, grain shape, cohesive constituents, resistances, etc.), since most methods can only be used in certain soils and with certain groundwater levels (dry, earth-damp, water-saturated) or do not work under certain groundwater levels. Furthermore, the methods may also be distinguished by the location of the starting or finishing point (shaft, excavation, surface of the land).

With regard to the method according to the invention, the prior art is best represented by the so-called pilot headings, microtunneling (microtunnel construction, controlled heading) and the controlled horizontal drilling technique (flush drilling method, horizontal directional drilling, HDD).

In the case of the pilot headings, the laying takes place in two or three working phases, a controlled pilot bore of a relatively small diameter always been created first and then, in a further step, this pilot bore being expanded to the final diameter and the product pipes being pushed or drawn in at the same time. In this case, the laying takes place from a starting shaft to a finishing shaft.

The drilling lengths which can be achieved by these methods are generally less than 100 m and the diameters of the pipes that can be laid approximately between 100 mm and 1000 mm. The drilling (and consequently the pipe laying) generally takes place in a straight line, i.e. controlling the pilot bore has the sole purpose of laying the pipe in as straight a line as possible (for example for gravity lines). Owing to the method, the pipe runs are fitted successively while the drilling is being carried out, or while the individual pipes are being laid (headings, possibly interim pipes or temporarily introduced pipes, product pipes). A further feature of these methods is that these methods are relatively sensitive to certain soil properties (displaceability, water level, etc.), so that for example they do not come into consideration for laying a relatively long, large-caliber steel pipeline or in rocky soil.

In the case of microtunneling (MT), a controlled, sometimes curved, bore is created from a starting shaft or a starting excavation to a finishing shaft or a finishing excavation. It is characteristic of these methods that the pilot drilling, expansion drilling and the operation of pushing in the pipes are performed in a single working step. This combined working step is carried out in principle in a pushing or forcing manner from the starting shaft or the starting excavation, and the heading pipes, not connected to one another in a tension-resistant manner, correspond at the same time to the product pipes to be laid.

With this method, drilling lengths of up to 500 m and drill hole diameters of more than 2000 mm can be achieved. In addition, microtunneling can be used in virtually all types of soil (loose or solid rock) and in cases of virtually all groundwater levels with water pressures (up to 3 bar, possibly more).

Although the use of steel or PE pipes, for example, is possible in principle, it is unusual on account of the accompanying technical difficulties. PE pipes have, for example, a very low compressive strength (about 10 $N/mm^2$) and consequently greatly restrict the possible laying range. Although steel pipes can be subjected to high axial loads, they must likewise be fitted pipe by pipe in the starting area and welded to one another in the process. For practical use, this has several disadvantages straightaway. On the one hand, the welding of large steel pipes is a time-consuming and complicated job (exact alignment and centering required), during which the actual drilling operation has to be interrupted. On the other hand, it is not possible before laying for the weld seams to be subjected to pressure testing, which is absolutely necessary for example when laying high-pressure gas lines or oil lines, since subsequent repair under the obstacle is virtually impossible.

Further disadvantages can be seen in the fact that steel pipe runs can only be controlled with great difficulty and it is accordingly necessary for the heading of such pipes to follow a generally straight laying plan, and the fact that the pipe casing (which is intended to protect the steel in the ground from corrosion) undergoes considerable loading during the heading, due to the direct contact with the wall of the drill hole, and is thereby damaged.

Finally, it should also be pointed out that, when steel or PE pipes that are designed as a pressure line are used, there is no possibility during heading to lubricate the outer casing of the pipes (for example with bentonite suspension), which leads to a significant increase in the casing friction occurring and, as a result, adversely influences the achievable drilling length.

The pipelines of relevance here (pressure pipelines of steel, PE, etc.) can consequently only be laid indirectly by means of microtunneling, in that conventionally a relatively large protective pipe string of normal heading pipes (concrete, polycrete, etc.) is laid, in which the actual product pipe run is then subsequently drawn or pushed. The disadvantages this procedure involves are obvious—creation of an actually too large drill hole diameter (for the protective pipes), costs for the protective pipes remaining in the ground, additional operation for the subsequent drawing-in of the product pipe run, costs caused by further equipment such as for example winches or the like.

In spite of all these disadvantages, the method described (microtunneling) represents the prior art for the laying of pressure pipelines in soils that are suitable for the controllable horizontal drilling technique described below (*Tunnels & Tunneling International*, March 2005, pages 18-21).

The third laying method to be mentioned in the context described here is the controllable horizontal drilling technique (abbreviated to "HDD" for horizontal directional drilling). With this three-phase method (pilot drilling, expansion drilling, drawing-in operation), only tension-resistant pipelines (for example of steel, PE or cast iron) can be laid. The geometrical laying capacities are superior to those for microtunneling in the case of the achievable length (>2000 m), but inferior in the case of the achievable pipe diameters (maximum about 1400 mm).

The greatest disadvantage of HDD is the great sensitivity to the ground conditions encountered in situ. In particular, gravelly, flinty or stony soils with less cohesive constituents almost always lead to problems if drill holes with a relatively large diameter (>800 mm) have to be created before the drawing-in operation.

The main reason for these difficulties is that, in the case of HDD, owing to the method, the drill hole is supported by the pumped drilling fluid alone (i.e. no interim pipes are fitted). In cases of unstable ground formations and large drill hole diameters, however, it is often not possible to achieve the required stability. Rather, the drill hole initially created collapses again in some regions after a certain time. As a result, it is virtually always impossible for a pipeline to be drawn in, and laying by means of HDD then fails (*Tunnels & Tunneling International*, March 2005, pages 18-21).

Additional difficulties for the HDD method, such as for example stones which jam between the wall of the drill hole and the pipe run while the pipe is being drawn in or damage said wall, and also the sometimes very high torques in cases of large drill hole diameters (for example in cases of drilling in solid rock), which have to be transmitted to the drilling head via the relatively thin drilling stem and not uncommonly lead to rupturing of the stem, are to be mentioned here only in passing. Similarly, the fact that, when using the HDD technique, owing to the method, the drill hole diameter has to be made about 1.3 to 1.5 times larger than the diameter of the product pipe run (otherwise there is the risk of seizing as a result of sloughing and sediment in the drill hole). This aspect is to be regarded as unfavorable from a technical and economic viewpoint.

To sum up the conclusions reached so far, it can be stated that none of the laying methods described is capable of laying a large-caliber, tension-resistant pipeline of great length reliably and effectively in difficult ground formations.

SUMMARY

The present invention is therefore based on the object of making trenchless laying of properly produced and tested, tension-resistant pipelines of relatively large diameter (for example about 800 mm-1400 mm) possible over relatively great laying lengths (for example about 250 m-750 m) in difficult soil types (such as for example gravels, crushed stones, rock etc.) under economical conditions.

This object is achieved by a method for laying pipes with the features of claim 1. Advantageous refinements of the invention are provided by the subclaims. Claim 16 relates to a heading pipe for use in the method according to the invention.

In the case of a preferred embodiment of the method according to the invention, a controlled heading is guided from a starting point under an obstacle to a finishing point, the drill hole already being expanded to the final diameter in the first working step. The soil that is loosened by the drill head during the drilling operation is hydraulically transported out of the drill hole. After the finishing point is reached, the drilling head is decoupled from the first heading pipe, and at the finishing point the first heading pipe is coupled to a connecting pipe. The connecting pipe is connected on the other side to the product pipe run, prepared in one piece on the surface of the land. This product pipe run is fitted into the drill hole, in that a pressing device exerts drawing forces on the heading pipes, which are connected to one another in a tension-resistant manner, and the heading pipes are thereby successively drawn to the starting point, the connecting pipe, which is connected to the heading pipes in a tension-resistant manner, and the product pipe run, which is connected to the connecting pipe in a tension-resistant manner, being simultaneously drawn into the drill hole. The product pipe run is consequently laid without a trench.

The combination of these features is not produced by any of the existing methods.

The method according to the invention is a controllable method, with the aid of which pipes of tension-resistant materials (for example steel, PE, etc.) that are preassembled (in the length of the drilling) (diameter for example about 800 mm-1400 mm) can be drawn into a curved drill hole over a great laying length (about 250 m-750 m) in virtually all soil types, the soil loosened at the drilling head being removed and hydraulically transported away (i.e. no soil displacement). The starting point of the drilling may in this case lie both in an excavation near the surface of the land and in a shaft, while the finishing point generally lies in an excavation near the surface of the land.

DESCRIPTION OF THE DRAWING FIGURES

Figure 3A:
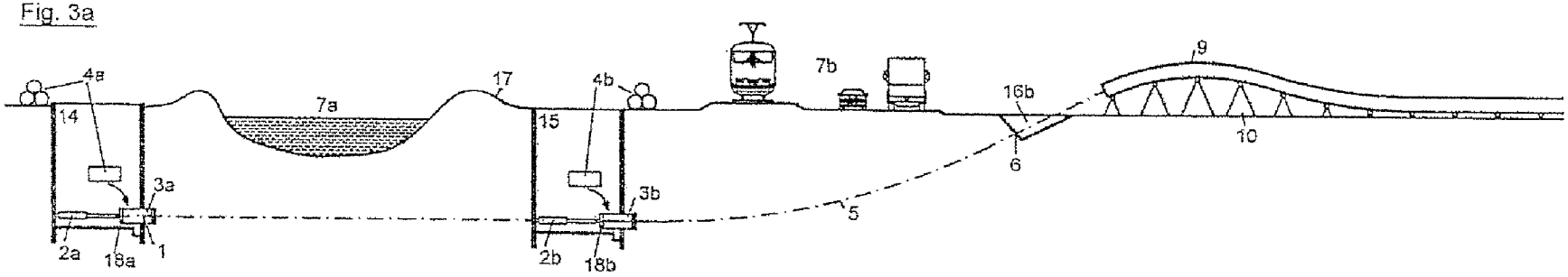
Figure 3B:
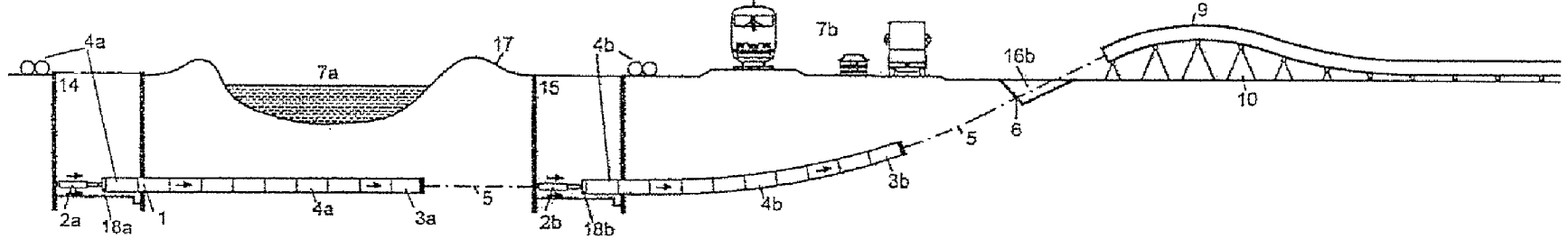
Figure 3C:
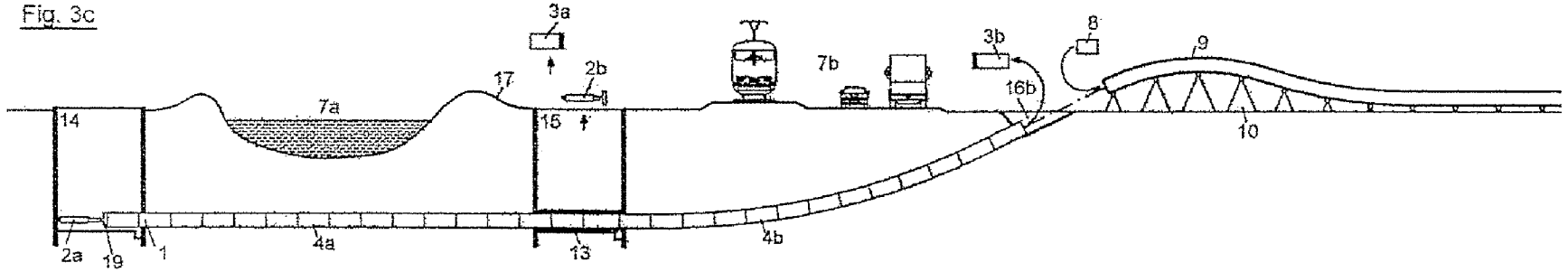
Figure 3D:
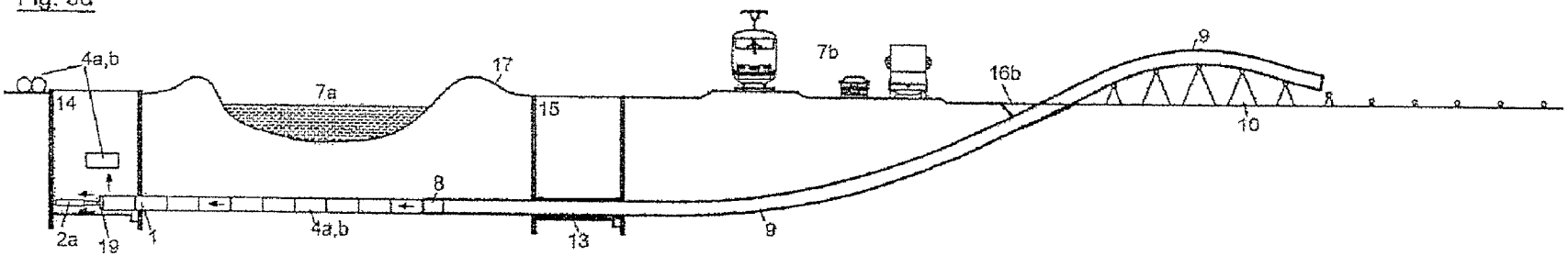
Figure 3E:
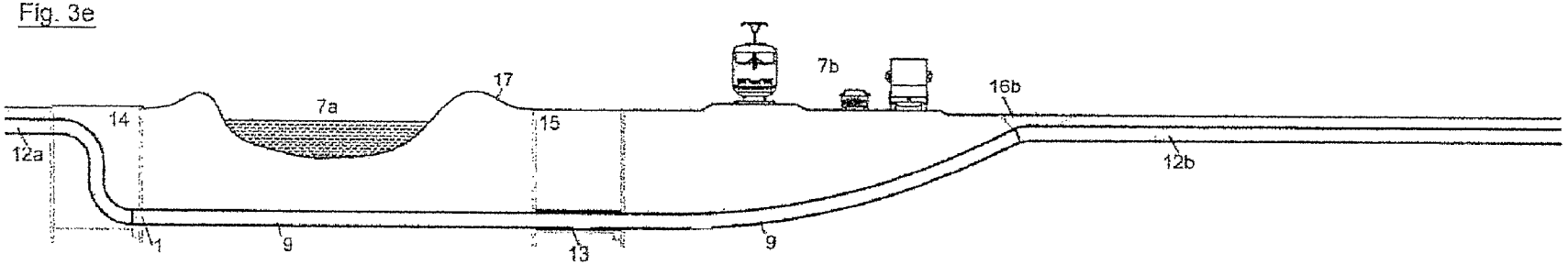
Figure 4:
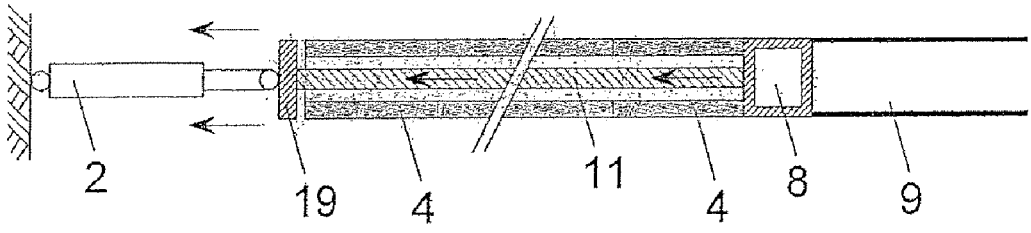
Figure 7:
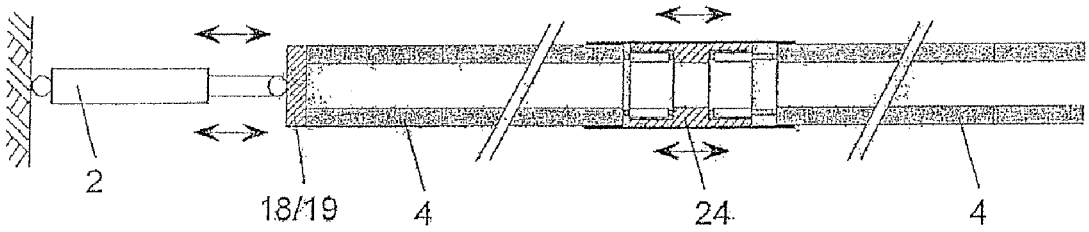
Figure 5:
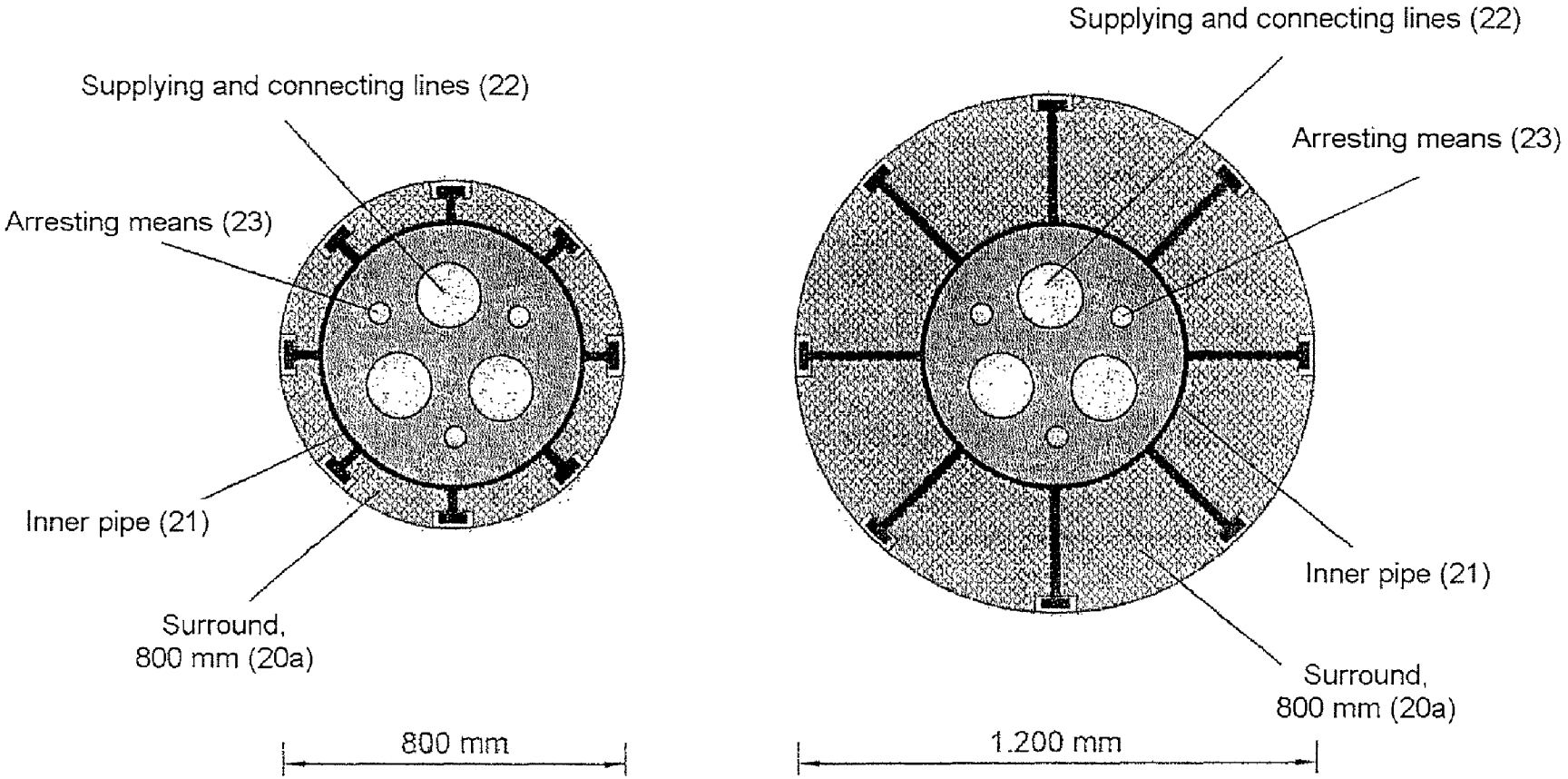
Figure 6:
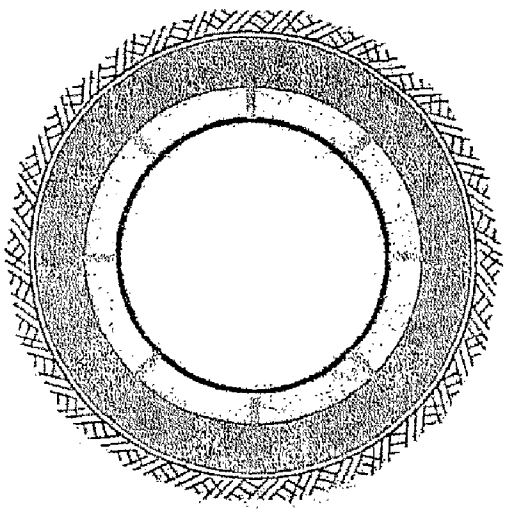
Figure 6:
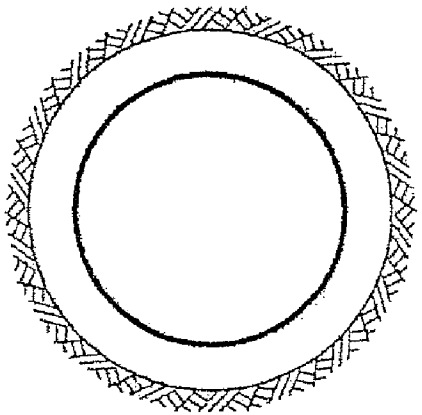
Figure 6:
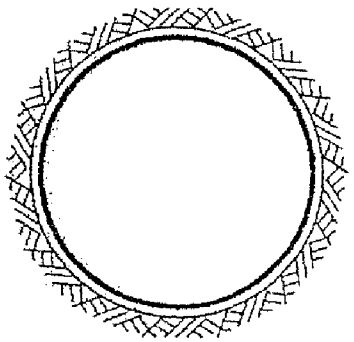

The invention is described in more detail below on the basis of exemplary embodiments. In the drawings:

FIG. 1 shows a schematic representation of possible ways in which the method according to the invention can be used in principle, to be precise in part a) a drilling line from an excavation under an obstacle to an excavation,
b) a drilling line from a starting shaft under an obstacle to an excavation,
c) a drilling line from an excavation under an obstacle to an intermediate shaft and from there under a further obstacle to an excavation and
d) a drilling line from a starting shaft under an obstacle to an intermediate shaft and from there under a further obstacle to an excavation, FIG. 2 shows a basic representation of the method according to the invention, in the case of a drilling line from a starting shaft under an obstacle to an excavation, to be precise in part a) a basic representation of the starting situation,
b) a basic representation of the creation of the drill hole, c) a basic representation of the preparations for the drawing-in of a product pipe run, d) a basic representation of the drawing-in of the product pipe run and e) a basic representation of the integration of the completely drawn-in product pipe run into an adjacent pipeline, FIG. 3 shows a basic representation of the method according to the invention in the case of a drilling line from a starting shaft under an obstacle to an intermediate shaft and from there under a further obstacle to an excavation, to be precise in part a) a basic representation of the starting situation, b) a basic representation of the creation of the drill holes, c) a basic representation of the preparations for the drawing-in of a product pipe run, d) a basic representation of the drawing-in of the product pipe run, e) a basic representation of the integration of the completely drawn-in product pipe run into an adjacent pipeline, FIG. 4 shows a basic representation of a drawing device lying within the heading pipes and its connection to a pressing station and the product pipe run, FIG. 5 shows a basic representation of a two-part heading pipe comprising an inner pipe and a surround of adaptable diameter, FIG. 6 shows a representation by way of example of the required drill hole cross sections for the laying methods of microtunneling, the horizontal drilling technique and the method according to the invention, represented for a product pipe run having an outside diameter of 1130 mm (an inside diameter of 1100 mm), and FIG. 7 shows a basic representation of an intermediate pressing station integrated in a run of heading pipes.

DETAILED DESCRIPTION OF THE PREFERRED EMBODIMENT

For the method according to the invention, a distinction can be drawn between two basic scenarios.

In the first scenario (FIG. 1*a*, FIG. 1*b*), the method according to the invention is carried out from a starting point 1 under an obstacle 7 or a number of obstacles 7*a*, 7*b*, etc. to a finishing point 6, it being possible for the starting point to lie either on the surface of the land 17 or in the direct vicinity of the surface of the land 17 in an excavation 16*a* or else in a starting shaft 14, while the finishing point 6 always lies on the surface of the land 17 or in the direct vicinity of the surface of the land 17 in an excavation 16*b*.

In the second scenario (FIG. 1*c*, FIG. 1*d*), an intermediate shaft 15 or a number of intermediate shafts 15*a*, 15*b*, etc. may be located between the starting point 1 and the finishing point 6. Between the starting point 1 and the finishing point 6 there is in turn generally an obstacle 7 that has to be passed under or there are a number of obstacles 7*a*, 7*b*, etc. that have to be passed under.

The method according to the invention and the devices that can be used thereby are described below by way of example and in detail for typical applications.

Example 1

In the first example (see FIGS. 2*a*-2*e*), the starting point 1 is in a starting shaft 14 and the finishing point 6 is in an excavation 16*b* near the surface of the land 17.

Figure 2A:
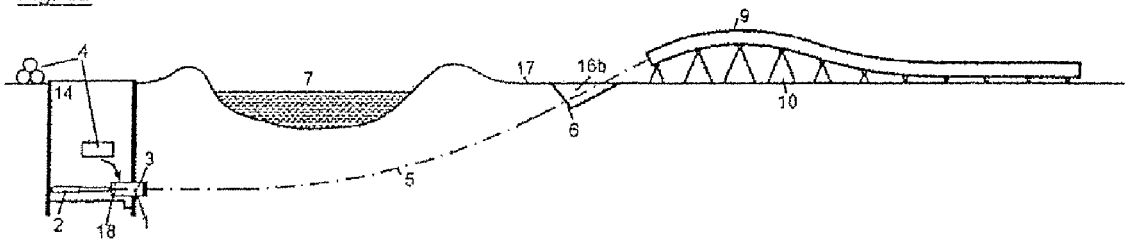

Firstly, a drilling device comprising, inter alia but not exclusively, the components of a pressing device 2, a pressing ring 18, a drilling head 3 and heading pipes 4 is prepared and set up in the starting shaft 14. This drilling device is substantially a customary microtunnel drilling device or heading device (FIG. 2*a*).

Figure 2B:
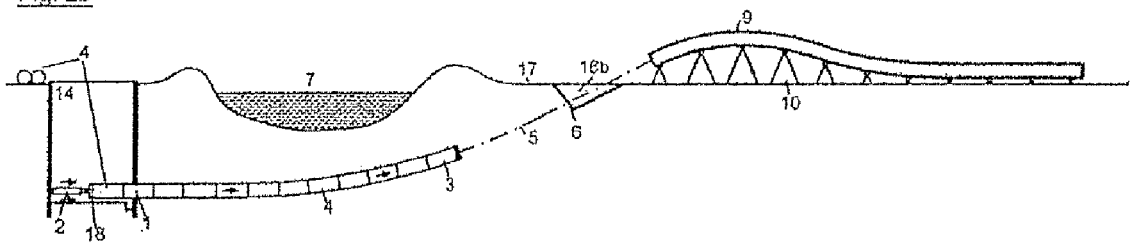

With the aid of this drilling device, a bore is driven in accordance with the applicable technical rules under controlled heading along a given drilling line 5, the drilling head 3 being subjected to the pressing force required for the drilling operation by the pressing device 2, via the pressing ring 18 and the heading pipes 4. Furthermore, the heading pipes 4 stabilize the drilling channel, so that collapsing of the drill hole is ruled out, even in unstable formations. Measuring the position of the drilling head 3 and controlling the same along the given drilling line 5 likewise take place in accordance with the applicable techniques of controlled heading (FIG. 2*b*).

Figure 2C:
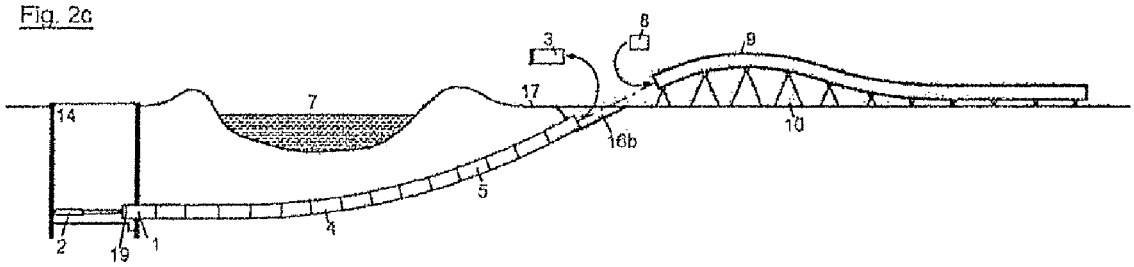

Once the drilling head 3 has arrived at the finishing point 6 in the excavation 16*b*, the drilling head 3 is separated from the heading pipes 4. After that, the first heading pipe 4 is connected in a tension-resistant manner to the product pipe run 9, prepared in the length of the drilling, by means of a connecting pipe 8 (FIG. 2*c*).

Figure 2D:
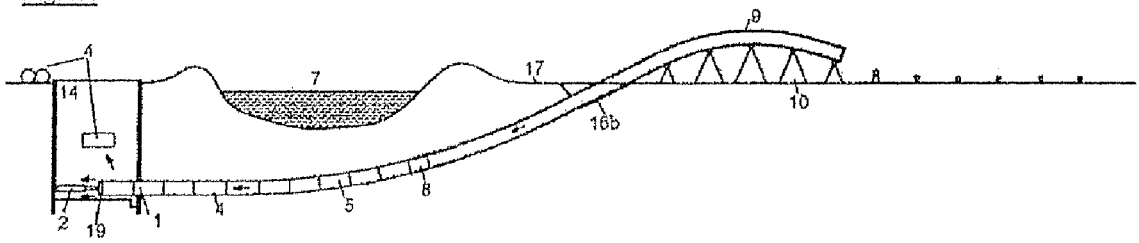

In the next working step, the heading pipes 4, coupled to one another by means of tension-resistant connections, are drawn by the pressing device 2 back through the drill hole by means of the drawing ring 19—which in the meantime has taken the place of the pressing ring 18 on the pressing device 2—, the connecting pipe 8 and the product pipe run 9 also being moved at the same time in the direction of the starting point—along the drilling line 5. In the starting shaft 14, the individual heading pipes are successively disassembled and removed from the starting shaft 14. In this case, the no longer required connecting lines, which supply the drilling head with electrical and/or hydraulic energy and control signals while the drilling is being carried out and also make the supply and disposal of drilling fluid possible (transporting and feeding line), are separated at the coupling locations of the heading pipes 4 and likewise removed from the shaft 14. This operation is continued until the connecting pipe 8 and the beginning of the product pipe run 9 have arrived in the starting shaft 14 (FIG. 2*d*).

Figure 2E:
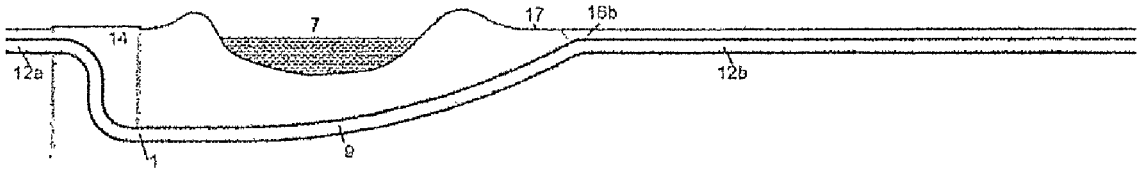

Then the connecting pipe 8 is separated from the product pipe run 9 and removed from the starting shaft 14. The pressing device 2 and the drawing ring 19 are then also disassembled and removed from the starting shaft 14. Finally, the product pipe run 9 can be connected to the pipeline 12*a* and 12*b* and the starting shaft 14 can be filled or restored to its original state (FIG. 2*e*).

Example 2

In a second example (see FIGS. 3*a*-3*e*), the starting point 1 is likewise in a starting shaft 14, but there is an intermediate shaft 15 between the starting point 1 and the finishing point 6. This situation may become necessary if the distance between the starting point 1 and the finishing point 6 is too great to be overcome by a single drilling operation (FIG. 3*a*).

In a preferred application, two drilling operations are then performed simultaneously with two separate drilling devices comprising, inter alia, the components of pressing devices 2*a* and 2*b*, pressing rings 18*a* and 18*b*, drilling heads 3*a* and 3*b* and heading pipes 4*a* and 4*b*, as described above. In this case, one drilling operation runs between the starting shaft 14 and the intermediate shaft 15 and the other drilling operation runs between the intermediate shaft 15 and the finishing point 6, respectively along the given drilling line 5 (FIG. 3*b*).

Once both drilling operations have reached their respective finishing points, the drilling heads 3*a* and 3*b* are removed from the heading pipes 4*a* and 4*b*. At the same time, the heading pipes 4*a* and 4*b* are connected to each other by means of additional heading pipes in the intermediate shaft and secured against buckling by means of a special guiding device 13 in the area of the intermediate shaft. In this case, the inner region of the guiding device 13 may be filled with lubricant (for example bentonite suspension), in order to reduce the frictional forces during the drawing-in operation. After that, the first heading pipe 4*b* is connected in a tension-resistant manner to the product pipe run 9, prepared in the length of the drilling, by means of a connecting pipe 8 (FIG. 3*c*).

In the next working step, the heading pipes 4*a* and 4*b*, coupled to one another by means of tension-resistant connections, are drawn by the pressing device 2*a* back through the drill hole by means of the drawing ring 19—which in the meantime has taken the place of the pressing ring 18*a* on the pressing device 2*a*—, the connecting pipe 8 and the product pipe run 9 also being moved at the same time in the direction of the starting point—along the drilling line 5. In the starting shaft 14, the individual heading pipes are successively disassembled and removed from the starting shaft 14. In this case, the no longer required connecting lines, which supply the drilling head 3*a* with electrical and/or hydraulic energy and control signals while the drilling is being carried out and also make the supply and disposal of drilling fluid possible (transporting and feeding line), are separated at the coupling locations of the heading pipes 4*a* and likewise removed from the shaft 14. This operation is continued until the connecting pipe 8 and the beginning of the product pipe run 9 have arrived in the starting shaft 14 (FIG. 3*d*).

Then the connecting pipe 8 is separated from the product pipe run 9 and removed from the starting shaft 14. The pressing device 2*a* and the drawing ring 19 are then also disassembled and removed from the starting shaft 14. Finally, the product pipe run 9 can be connected to the pipeline 12*a* and 12*b* and the starting shaft 14 and the intermediate shaft 15 can be filled or restored to their original state (FIG. 3*e*).

Example 3

A further preferred application (see FIG. 4) is for example when the bore is initially driven by conventional heading pipes 4, i.e. heading pipes which are connected in a compression-resistant but not tension-resistant manner.

In this application, it is envisaged to transmit the required drawing forces from the pressing device 2 and the interposed drawing ring 19 to the connecting pipe 8 via a drawing device 11 lying inside the heading pipes. In this case, the connecting pipe 8 then exerts a compressive force on the heading pipes 4, while at the same time it exerts a drawing force on the product pipe run 9 (FIG. 4).

The fitting of the drawing device 11 in the heading pipes 8 may take place simultaneously with the fitting of the heading pipes 4 during the creation of the bore, or else subsequently, after the drilling head 3 has been removed at the finishing point 6.

In a further preferred application, the required lines for the drilling fluid circuit (transporting and feeding line) are used during the drawing-in operation as a drawing device 11. For this purpose, they correspondingly have to be connected to the drawing ring 19 at the starting point 1 and the connecting pipe 8 at the finishing point 6 before the beginning of the drawing-in operation.

Example 4

The heading pipes 4 may optionally also be of a two-part configuration, see FIG. 5. In this case, it is envisaged in a preferred configurational variant to use an inner pipe of a relatively small diameter (for example 600 mm), around which a surround 20*a* or 20*b* is fitted, in dependence on the outside diameter of the product pipe run 9 to be laid.

As a result, it is possible to use the same, relatively complexly constructed inner pipe—in which for example the supplying and connecting lines 22 for supplying and controlling the drilling head are already integrated—for different outside diameters of the product pipe run 9, in that a correspondingly matching surround 20*a*, 20*b*, etc. is fitted.

In addition, an arresting means 23 may be envisaged in a preferred configurational variant of the heading pipes 4, preventing the heading pipes from twisting with respect to one another while the drilling is being carried out or during the drawing-in operation.

Example 5

As a consequence of the envisaged procedure, it is possible to set the required drill holes optimally in their diameter to the diameter of the product pipe run 9. As a result, the required drill hole volume is reduced to a minimum, which in particular reduces the technical risk of the construction project and at the same time lowers the construction costs.

The situation is represented in FIG. 6 by way of example for a product pipe run of an outside diameter of 1130 mm, the respective drill hole diameters of the different methods having being dimensioned for this example in accordance with the recognized rules of the art.

Example 6

Should the heading forces happen to exceed the capacity of the pressing device 2 or the strength of the heading pipes 4 during the creation of the bore along the drilling line 5, it is possible, by analogy with the procedure in the case of microtunneling, to integrate so-called intermediate pressing or extender stations 24 in the heading run, see FIG. 7.

These are substantially pressing devices which are fitted in pipes in a way similar to the heading pipes 4. As a difference from the applications in microtunneling, however, a device acting on both sides is provided in the case of the method according to the invention, i.e. both compressive and drawing forces can be exerted by the intermediate pressing station on the heading pipes 4 adjoining on both sides.

It can generally be assumed that the required forces during the creation of the bore itself are higher than during the drawing-in of the product pipe run 9, since for example the pressing forces for the drilling head 3 are eliminated and, inter alia, the casing friction is less than during the drilling operation itself as a result of the annular gap that can optionally be chosen to be greater and also as a result of the "modeling" of the wall of the drill hole that can be achieved during the drilling operation and the lubricating film thereby produced. For these reasons, it may be envisaged that the actual drawing-in operation is performed by the pressing station 2 alone.

LIST OF DESIGNATIONS

1 starting point
2 pressing device (a, b, etc.)
3 drilling head (a, b, etc.)
4 heading pipes (a, b, etc.)
5 drilling line
6 finishing point
7 obstacle (a, b, etc.)
8 connecting pipe

9 product pipe run
10 roller conveyor
11 drawing device
12 pipeline (a, b)
13 guiding device in intermediate shaft
14 starting shaft
15 intermediate shaft (a, b, etc.)
16 excavation (a, b)
17 surface of the land
18 pressing ring (a, b, etc.)
19 drawing ring
20 surround (a, b, etc.)
21 inner pipe
22 connecting and supplying lines
23 arresting means
24 extender station

The invention claimed is:

1. A method for laying pipes, in which a controlled heading is carried out from a starting point under an obstacle to a finishing point, said method comprising the steps of:

creating a drill hole during the heading by a drill head, and pressing the drill head forward by means of a pressing device over a heading run made up of heading pipes, said creating step further including the step of expanding the drill hole to the final diameter in this working step, removing and transporting out of the drill hole the soil loosened by the drilling head during the drilling operation, after the finishing point is reached, coupling on a product pipe run, which is prepared on a land surface, and has product pipes which are connected to one another in a tension-resistant manner, and successively drawing back the heading pipes to the starting point, the product pipe run simultaneously being drawn after them into the drill hole and consequently laid without a trench.

2. The method as claimed in claim 1, said step of transporting the loosened soil out of the drill hole being performed wherein the soil loosened by the drilling head during the drilling operation is removed and hydraulically transported out of the drill hole; and after the finishing point is reached, decoupling the drilling head from the first heading pipe, coupling the first heading pipe to a connecting pipe device at the finishing point, connecting the connecting pipe device at its end opposite from the first heading pipe in a tension-resistant manner to the product pipe run, which is prepared in one piece on the surface of the land, inserting the product pipe run into the drill hole, wherein the pressing device exerts forces on the heading pipes and, as a result, the heading pipes are successively drawn to the starting point, the connecting pipe device and the product pipe run connected to the connecting pipe device simultaneously being drawn after them into the drill hole and the product pipe run consequently being laid without a trench.

3. The method as claimed in claim 2;

installing an intermediate shaft between the starting point and the finishing point, driving a bore from the starting point to the intermediate shaft and, approximately at the same time, driving a bore from the intermediate shaft to the finishing point, said step of transporting the loosened soil out of the drill hole being performed wherein the soil loosened by the respective drilling heads during the drilling operation is removed and hydraulically transported out of from the respective bores, after the intermediate shaft or the finishing point is reached, decoupling the drilling heads from the respective first heading pipes;

connecting the heading pipes of the respective individual bores to one another in the intermediate shaft; and providing a guide for the heading pipes in the area of the intermediate shaft, fitting the product pipe run into the drill hole, wherein the pressing device located at the starting point exerts forces on the heading pipes that are connected to one another and, as a result, the heading pipes are successively drawn to the starting point, the connecting pipe device connected to the heading pipes and the product pipe run connected to the connecting pipe device simultaneously being drawn after them into the drill hole and the product pipe run consequently being laid without a trench.

4. A method as claimed in claim 3, installing more than one intermediate shaft between the starting point and the finishing point.

5. The method as claimed in claim 3, at the guide in the intermediate shaft, feeding lubricant into an annular space between the guide and the heading pipes or product pipe run.

6. The method as claimed in claim 3; and said creating step wherein separate drilling equipment is used for each of the bores.

7. The method as claimed in claim 2; and connecting the heading pipes to one another in a tension-resistant manner and coupling the first heading pipe in a tension-resistant manner to the connecting pipe device at the finishing point.

8. The method as claimed in claim 2; and transmitting the drawing force required for the drawing-in operation from the pressing device to the connecting pipe device via a drawing ring by means of a drawing device located inside the heading pipes.

9. The method as claimed in claim 2; and lubricating the annular space between the product pipe run and the wall of the drill hole during the drawing-in operation.

10. The method as claimed in claim 1, wherein the starting point and the finishing point lie in an open excavation.

11. The method as claimed in claim 1, wherein the starting point lies in a shaft the finishing point lies in an open excavation.

12. The method as claimed in claim 1, wherein the heading pipes have a greater outside diameter than the product pipe run.

13. The method as claimed in claim 1, wherein the heading pipes have arresting means which prevent twisting of the heading pipes in the drill hole.

14. The method as claimed in claim 1; and providing, in the heading pipes, devices for feeding lubricant into the annular space between the heading pipe and the wall of the drill hole.

15. The method as claimed in claim 1; and arranging in the heading run at least one intermediate pressing station, which acts on both sides and is connected to the neighboring heading pipes in a compression-resistant and tension-resistant manner.

16. A heading pipe for use in a method as claimed in claim 1, said heading pipe comprising:

an inner pipe, which is set up for receiving and passing on the forces occurring and for receiving the required elongated member to the drilling head, with the elongated member being selected from the group consisting of connecting lines, empty pipes, and combinations thereof; and an outer surround, which can be fitted on and can be adapted in its diameter to the product pipe run to be laid.

17. The heading pipe as claimed in claim 16, said elongated member being integrated in the inner pipe.

18. The heading pipe as claimed in claim 16, said elongated member being integrated in the surround.

19. The method as claimed in claim 1; and providing at least one intermediate shaft between the starting point and the finishing point.

20. The method as claimed in claim 1, said product pipe run being prepared on the surface of the land in one piece.

* * * * *